US009266122B2

(12) United States Patent
Kjær

(10) Patent No.: US 9,266,122 B2
(45) Date of Patent: Feb. 23, 2016

(54) CENTRIFUGAL SEPARATOR HAVING A FEED ACCELERATOR

(75) Inventor: Allan Otto Kjær, Hvidovre (DK)

(73) Assignee: Alfa Laval Corporate AB, Lund (SE)

( * ) Notice: Subject to any disclaimer, the term of this patent is extended or adjusted under 35 U.S.C. 154(b) by 1107 days.

(21) Appl. No.: 13/376,464

(22) PCT Filed: Jun. 11, 2010

(86) PCT No.: PCT/DK2010/050137

§ 371 (c)(1),
(2), (4) Date: Feb. 29, 2012

(87) PCT Pub. No.: WO2010/142300

PCT Pub. Date: Dec. 16, 2010

(65) Prior Publication Data

US 2012/0157289 A1 Jun. 21, 2012

(30) Foreign Application Priority Data

Jun. 12, 2009 (DK) ..... 2009 70026

(51) Int. Cl.
*B04B 1/20* (2006.01)
*B04B 11/02* (2006.01)

(52) U.S. Cl.
CPC ..... *B04B 1/20* (2013.01); *B04B 1/2016* (2013.01); *B04B 11/02* (2013.01); *B04B 2001/2033* (2013.01)

(58) Field of Classification Search
CPC .. B04B 2001/2033; B04B 1/20; B04B 11/02; B04B 1/2016
USPC ..... 494/52–54, 56, 84; 210/377, 380.1, 210/380.3
See application file for complete search history.

(56) References Cited

U.S. PATENT DOCUMENTS 3,279,687 A 10/1966 Amero
3,428,246 A 2/1969 Finkelston
(Continued)

FOREIGN PATENT DOCUMENTS

CA 766609 A 9/1967
CN 1377303 10/2002
(Continued)

OTHER PUBLICATIONS

First Office Action with Search Report for CN Corresponding Application No. 201080026418.X, issued on Jun. 19, 2013, pp. 1-5.
(Continued)

*Primary Examiner* — Charles Cooley
(74) *Attorney, Agent, or Firm* — MKG, LLC

(57) ABSTRACT

The centrifugal separator has a rotating bowl and a rotating conveyor with an acceleration chamber arranged coaxially within the bowl. The centrifugal separator further has a separation chamber, which is radially limited by the bowl and the conveyor, respectively, and the acceleration chamber is provided with feed ports for inlet of feed material into the separation chamber. A feed accelerator is arranged coaxially within the acceleration chamber and is rotating in use around a common axis of rotation relative to the conveyor at a lower speed than the conveyor. The feed accelerator has a discharge outlet for discharge of feed material into the acceleration chamber of the conveyor. The feed ports extend a first axial area and the discharge outlet extends a second axial area, whereby the first and the second axial area are overlapping.

10 Claims, 5 Drawing Sheets

(56) References Cited

U.S. PATENT DOCUMENTS

| | | | | | |
|---|---|---|---|---|---|
| 3,499,602 | A | | 3/1970 | Nilson | |
| 3,532,264 | A | | 10/1970 | Amero | |
| 3,568,920 | A | * | 3/1971 | Nielsen | 494/53 |
| 4,142,669 | A | * | 3/1979 | Burlet | 494/53 |
| 4,334,647 | A | * | 6/1982 | Taylor | 494/37 |
| 4,784,634 | A | | 11/1988 | Schiele | |
| 5,345,255 | A | | 9/1994 | Nguyen et al. | |
| 5,354,255 | A | * | 10/1994 | Shapiro | 494/53 |
| 5,374,234 | A | | 12/1994 | Madsen | |
| 5,401,423 | A | | 3/1995 | Leung et al. | |
| 5,527,474 | A | | 6/1996 | Leung | |
| 6,077,210 | A | | 6/2000 | Leung et al. | |
| 6,241,901 | B1 | | 6/2001 | Leung | |
| 6,749,552 | B1 | | 6/2004 | Figgener et al. | |
| 7,018,326 | B2 | * | 3/2006 | Koch et al. | 494/53 |
| 7,060,019 | B2 | * | 6/2006 | Hermeler et al. | 494/53 |
| 7,247,133 | B2 | * | 7/2007 | Gronnegaard et al. | 494/53 |
| 7,282,019 | B2 | * | 10/2007 | Lantz | 494/54 |
| 7,862,493 | B2 | * | 1/2011 | Haider et al. | 494/53 |
| 2002/0132718 | A1 | | 9/2002 | Koch et al. | |
| 2003/0224920 | A1 | | 12/2003 | Leung | |
| 2003/0228966 | A1 | | 12/2003 | Koch et al. | |
| 2005/0245381 | A1 | | 11/2005 | Tettleton et al. | |
| 2006/0105896 | A1 | * | 5/2006 | Smith et al. | 494/7 |
| 2012/0157289 | A1 | * | 6/2012 | Kjær | 494/51 |
| 2015/0314306 | A1 | * | 11/2015 | Moberg | B04B 1/20 494/68 |

FOREIGN PATENT DOCUMENTS

| | | | | |
|---|---|---|---|---|
| DE | 3638782 | A1 | | 5/1988 |
| DE | 3723864 | A1 | * | 1/1989 |
| EP | 0156311 | A2 | | 10/1985 |
| FR | 1387605 | A | | 3/1964 |
| JP | 61161156 | A | | 7/1986 |
| RU | 2223151 | C2 | | 10/2004 |
| WO | 93/10906 | A1 | | 6/1993 |
| WO | 9310907 | | | 6/1993 |
| WO | 9313865 | A1 | | 7/1993 |
| WO | 2007104455 | A1 | | 9/2007 |

OTHER PUBLICATIONS

Decision to Grant from corresponding Russian Patent Application No. 2012100727/05(001057), dated May 5, 2014.

* cited by examiner

CENTRIFUGAL SEPARATOR HAVING A FEED ACCELERATOR

FIELD OF THE INVENTION

The present invention relates to a centrifugal separator comprising: a bowl rotating in use around an axis of rotation, said axis of rotation extending in a longitudinal direction of said bowl, a radial direction extending perpendicular to the longitudinal direction, a conveyor arranged coaxially within said bowl and rotating in use around said axis of rotation, said conveyor comprising an acceleration chamber, a separation chamber being radially outwards limited by said bowl and radially inwards limited by said conveyor, said acceleration chamber being provided with feed ports for inlet of feed material into the separation chamber, and a feed accelerator arranged coaxially with said conveyor within said acceleration chamber and rotating in use around said axis of rotation relative to the conveyor at a lower speed than the conveyor, said feed accelerator having a discharge outlet for discharge of feed material trough said discharge outlet into said acceleration chamber of the conveyor.

BACKGROUND

A centrifugal separator of this art is known. Thus U.S. Pat. No. 4,334,647 discloses a decanter centrifuge comprising a bowl and a conveyor with an acceleration chamber and a feed accelerator in the acceleration chamber, the feed accelerator being joined to a feed pipe and having semi-circular acceleration vanes. The bowl and feed pipe are rotated at predetermined rotational speed rates by a drive motor via respective pulleys and belts. In use a pond of feed material is formed in the bowl. The acceleration chamber extends into the pond and comprises a number of axial openings for feed material to flow from the feed accelerator, through the acceleration chamber and into the bowl forming jets. There is a risk that solids in the feed material will sediment already in the acceleration chamber thus blocking the passage into the bowl.

Generally the provision of suited feed inlets for centrifugal separators is the subject of a big number of patents. U.S. Pat. No. 5,345,255 discloses a decanter centrifuge comprising a bowl and a conveyor with an inlet chamber having an open construction in that a hub of the conveyor at the inlet chamber, or feed zone, is constituted by longitudinal ribs only, providing between them large ports for feed material introduced into the inlet chamber to flow radially into the bowl. Hereby the feed material, or liquid, is accelerated slowly in the feed zone, or inlet chamber, to the rotational speed of the conveyor. According to its description this slow acceleration is due to the lack of any accelerating surface within the feed zone. The slow acceleration causes the volume of feed in the feed zone to increase so that its centrifugal pressure forces outward movement. Due to enlarged areas through which the feed liquid can reach the level of feed material or liquid, called "the pond" (without passage through nozzles and openings which create concentrated flows or jets), turbulence is avoided in the pond at the feed zone.

U.S. Pat. No. 5,401,423 discloses centrifugal separator with a feed accelerator system including an accelerator disc, whereby the centrifugal separator comprises many of the features mentioned above in the opening paragraph. However the accelerator disc is attached to the conveyor hub to rotate therewith at the same speed as the conveyor.

SUMMARY

According to the invention this is obtained by a centrifugal separator wherein the said feed ports extend in a first axial area and said discharge outlet extends in a second axial area, the first and the second axial area overlapping mutually such that feed material flows from the discharge outlet through the feed ports in a direction having a radial and a circumferential component. Preferably the second axial area extends within the first axial area. Providing in this way for the feed material to pass in a radial direction from the discharge outlet through the feed ports into the separation chamber ensures a free passage of the feed material.

In a preferred embodiment the feed accelerator comprises an inlet tube, said discharge outlet being provided by a discharge port in a side wall of said inlet tube and a casing having a curved wall part extending from said discharge port, such that said wall part extends tangentially from said inlet tube. Hereby it is obtained that feed material discharges laterally from the inlet tube to be accelerated by the curved wall without the risk of e.g. threads or fibres in the feed material getting stuck on protruding edges.

In a preferred embodiment, the feed accelerator comprises two discharge outlets. This feature provides for symmetry of rotation of the accelerator to avoid unbalances.

Preferably, the casing of the discharge outlet is provided by an exchangeable casing. This provides for exchange of the casing in case of wear from accelerating an abrasive feed material.

Preferably, the exchangeable casing comprises mountings adapted for attachment of said casing to said inlet tube through said feed ports. This provides for an easy assembly of the inlet tube with the accelerator and the conveyor.

Preferably, the casing is at an end thereof opposite the inlet tube provided with a wear pad. Solid material in the feed material that may during use sediment in the acceleration chamber between feed ports will be hit by the casing to be knocked or scraped off and exit through an adjacent feed port. By providing a wear pad, preferably an exchangeable wear pad, it is avoided that the casing proper is abraded by the impact with any sediment material.

In a preferred embodiment a first drive is provided for rotating the conveyor, preferably through the bowl, and a second drive is provided for rotating the feed accelerator, said first and second drives being controlled independently, such that in use, the angular velocity of said feed accelerator is set independent from the angular velocity of said conveyor. Hereby, it is obtained that the rotational speed of the accelerator may be adjusted to provide for the feed material to hit a surface of material inside the separation chamber with a circumferential speed equal to the circumferential speed of the material in the separation chamber, thus causing only little turbulence.

In a preferred embodiment the centrifugal separator comprises a means for monitoring the power consumption of said first and second drives, whereby the overall power consumption of said first and second drives is determined. When feed material hits the surface of material in the separation chamber with an optimum speed, a minimum of turbulence is caused. Since turbulence entails loss of energy, the condition of optimum speed condition may be registered as the condition requiring a minimum of overall power consumption of the first and the second drive.

Preferably, the feed ports are defined by mutually spaced ribs extending in the direction of said axis of rotation. This provides for an open construction with a minimum of disturbance of the flow of feed material from the discharge outlet to the surface of material in the separation chamber.

Other objectives, features and advantages of the present invention will appear from the following detailed disclosure, from the attached claims as well as from the drawings.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present invention, will be better understood through the following illustrative and non-limiting detailed description of a preferred embodiment of the present invention, with reference to the appended schematic drawings, where the same reference numerals will be used for similar elements, wherein.

DETAILED DESCRIPTION

Figure 1:
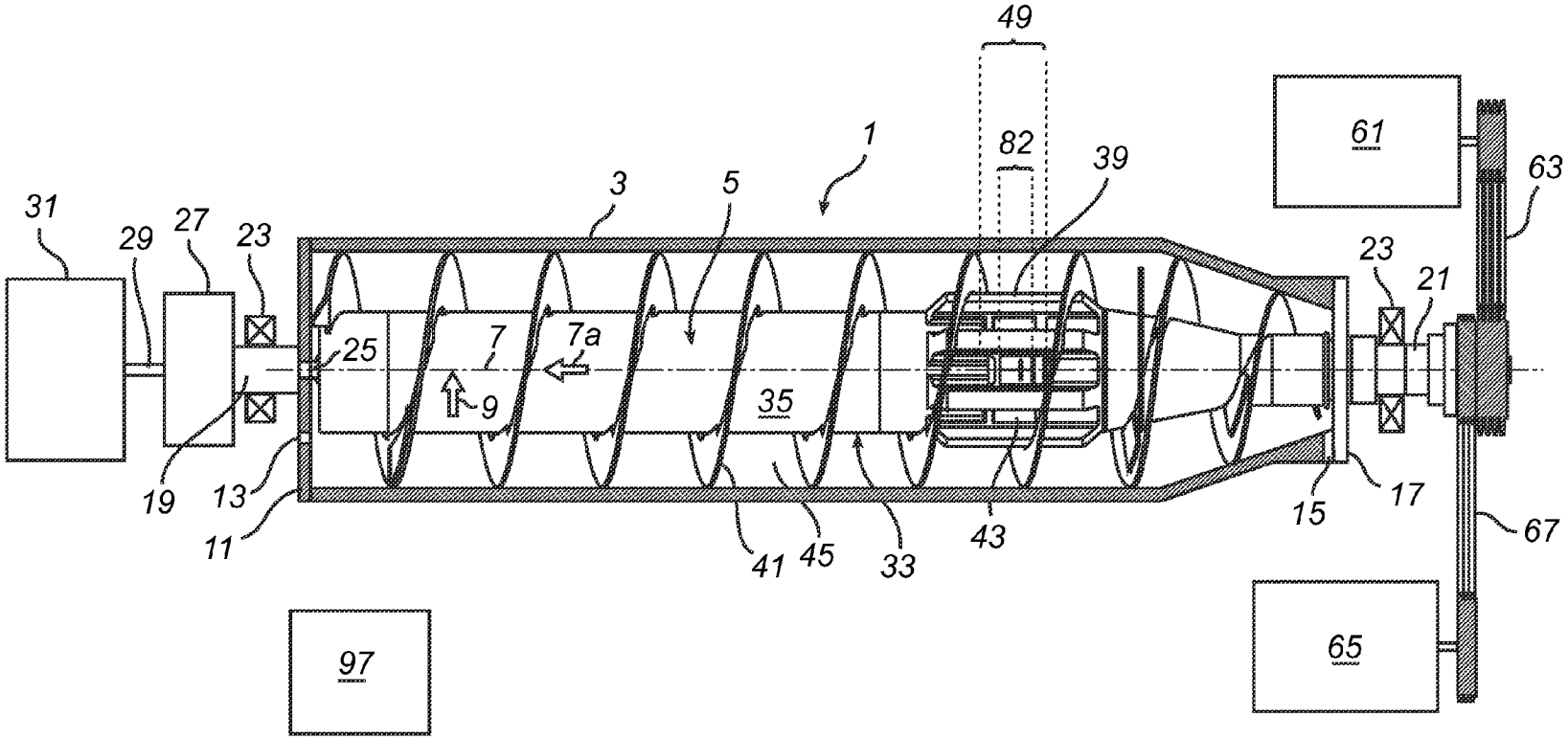
FIG. 1 shows a decanter centrifuge partly in section.

FIG. 1 shows a centrifugal separator or a decanter centrifuge 1 comprising a bowl 3 and a screw conveyor 5 which are mounted such that they in use can be brought to rotate around an axis 7 of rotation extending in a longitudinal direction 7*a* of the decanter centrifuge. Further, the decanter centrifuge 1 has a radial direction 9 extending perpendicular to the longitudinal direction.

For the sake of simplicity directions "up" and "down" are used herein as referring to a radial direction towards the axis 7 of rotation and away from the axis 7 of rotation, respectively.

The bowl 3 comprises a base plate 11 provided at one longitudinal end of the bowl 3. The base plate 11 is provided with a number of light phase outlet openings 13. Furthermore the bowl 3 is at an end opposite to the base plate 11 provided with heavy phase outlet openings 15, which are provided next to a flange 17 closing the bowl 3 at the end opposite the base plate 11. A base shaft 19 is attached to the base plate 11 and second shaft 21 is attached to the flange 17. These two shafts 19, 21 are supported in bearings 23 for rotation of the bowl 3 about the axis 7 of rotation.

In a manner known per se the base shaft 19 is hollow, and a conveyor shaft 25 is extending therethrough. The conveyor shaft 25 is supported relative to the base shaft 19 through a bearing, not shown, for the screw conveyor 5 to rotate relative to the bowl 3 about the axis 7 of rotation. The base shaft 19 and the conveyor shaft 25 are in a manner known per se interconnected through an epicyclical gear train 27 and a mutual rotation of the two shafts 19 and 25 is regulated through a control shaft 29 by a control motor 31.

The screw conveyor 5 comprises a hub 33 with a cylindrical part 35 and a generally conical part 37, the two parts 35 and 37 being interconnected by broad mutually spaced ribs 39 extending in the longitudinal direction. The hub 33 carries a helical conveyor flight 41 for transporting during use a heavy phase towards the heavy phase outlet openings 15. Between the cylindrical part 35 and the conical part 37 of the hub 33 an inlet chamber or acceleration chamber 43 is provided. Between the hub 33 and the bowl 3 a separation chamber 45 is provided. Feed ports 47 (see FIG. 2) are provided between the acceleration chamber 43 and the separation chamber 45, and they are defined in a circumferential direction 46 by the mutually spaced ribs 39 and in the longitudinal direction by the cylindrical part 35 and the conical part 37 of the hub 33. Thus the feed ports 47 extend a first axial area 49 (FIG. 2).

Figure 2:
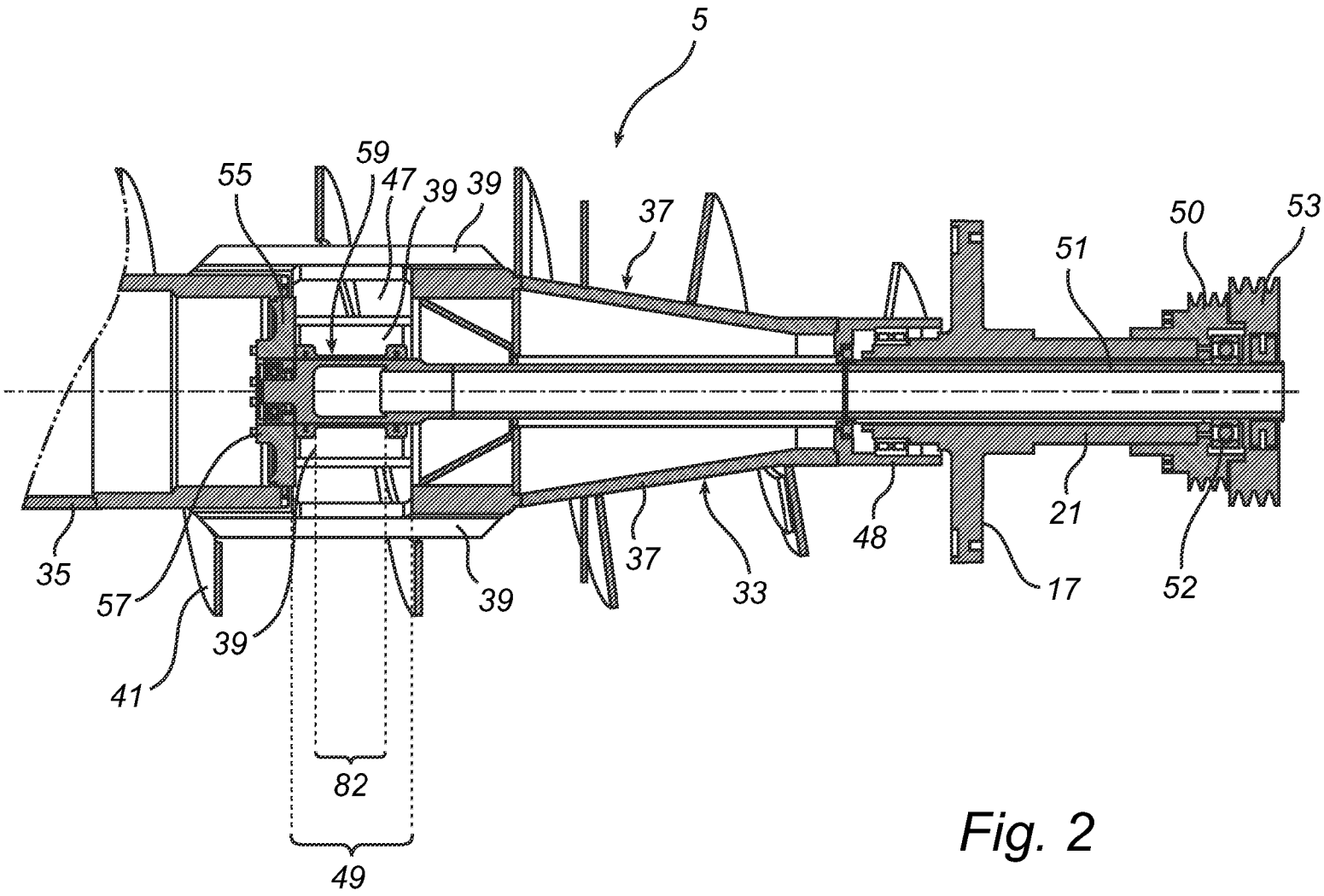
FIG. 2 shows a section of a part of a conveyor of the centrifuge.

Referring to FIG. 2 it is seen that the second shaft 21 extends into the conical part 37 of the conveyor hub 33 to support the latter rotatably through a bearing 48. A pulley 50 is mounted on the second shaft 21. A feed pipe 51 extends through the second shaft 21 and the conical part 37 and is rotatably supported through a bearing 52. A pulley 53 is mounted on the feed pipe 51. A mounting disc 55 is sealingly mounted in the cylindrical part 35 of the conveyor hub 33. The mounting disc receives sealingly and releasably a bearing 57 supporting a feed accelerator 59 attached to the feed pipe 51. A feed pipe motor 61 is provided or driving the feed pipe 51 rotationally through belts 63 and the pulley 53. Thus the feed pipe 51 may be rotated around the longitudinal axis 7. A main motor 65 is providing for driving the second shaft 21 rotationally through belts 67 and the pulley 50. Thus the main motor 65 through belts 67, the pulley 50, the second shaft 21, the flange 17, the bowl 3, the base plate 11, the base shaft 19, the epicyclical gear train 27 and the conveyor shaft 25 provide a first drive for the conveyor, and the feed pipe motor 61 provide through belts 63, the pulley 53 and the feed pipe 51 a second drive for the feed accelerator 59.

Figure 3:
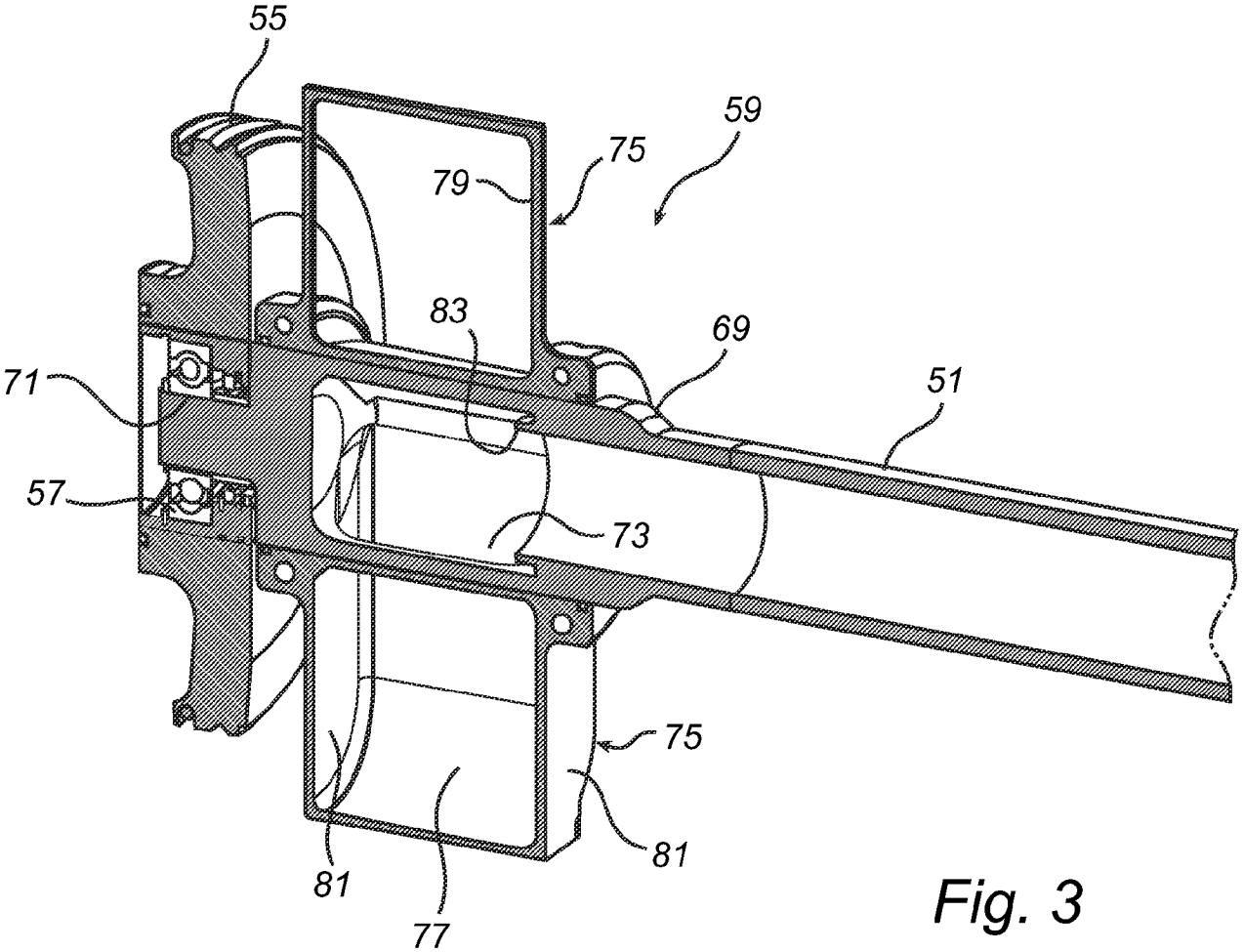
FIG. 3 shows a section of a feed accelerator.
Figure 4:
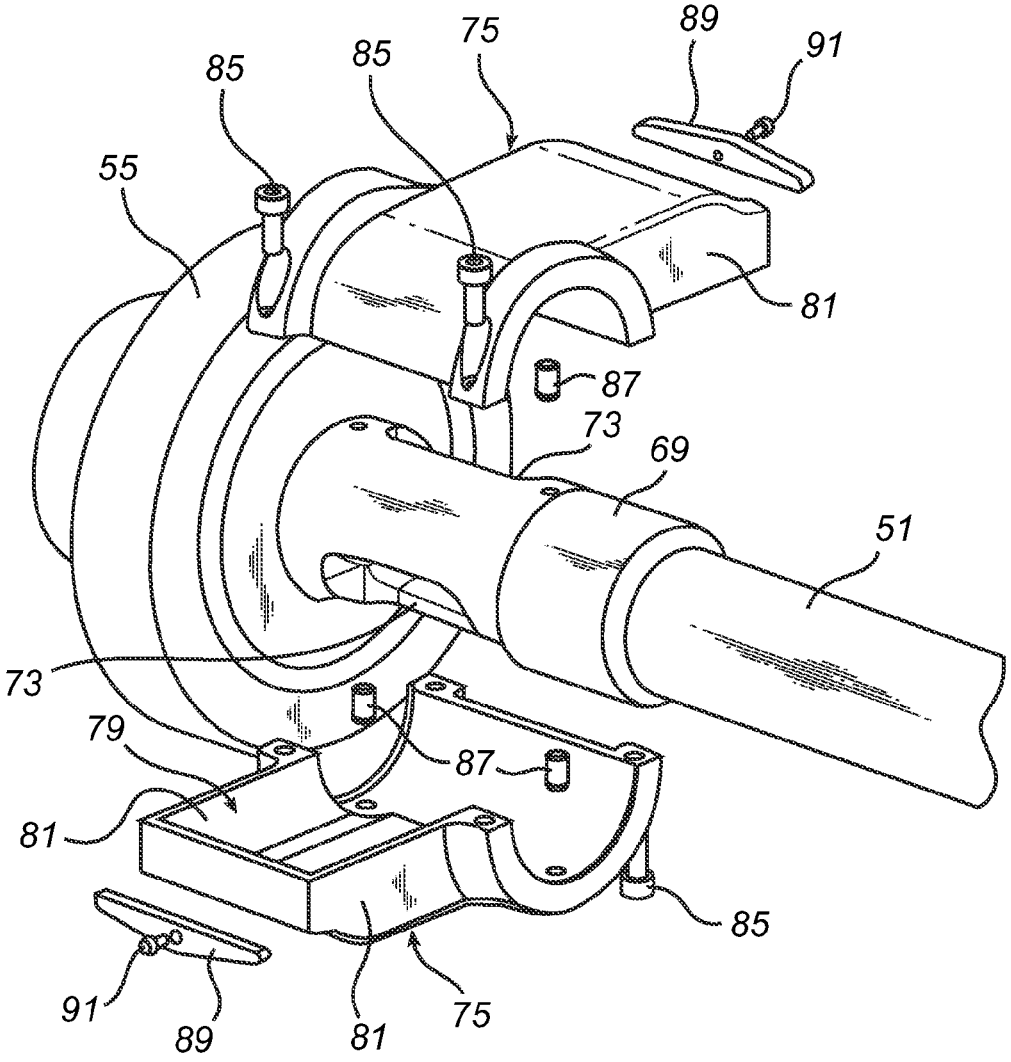
FIG. 4 shows an exploded view of the feed accelerator.

Referring to FIGS. 3 and 4 the feed accelerator 59 comprises a tubular part 69 welded onto the feed pipe 51 to be integral therewith and constitute an inlet tube, said tubular part being closed at an end opposite the feed pipe and carrying an axle journal 71 attached to the bearing 57. Two discharge ports 73 are provided in the sidewall of the tubular part 69 and two casing elements 75 are mounted on the tubular part 69. Each casing element comprises a curved wall part 77 extending, when the casing element is mounted, from one end, in which it is tangential to the inner side of the sidewall of the tubular part 69. The curved wall part extends away from the tubular part to a discharge opening 79 defined by the casing element 75. At the discharge opening 79 the curved wall extends in the circumferential direction 46. The casing elements further comprise sidewall parts 81 defining the extent of the discharge openings 79 in the longitudinal direction. Thus the discharge openings 79 extend a second axial area 82 situated within the first axial area 49 (see FIG. 2). The discharge ports 73 and the casing elements 75 together constitute discharge outlets. The tubular part comprises an axial flange 83 for restricting backflow in a manner known per se.

The casing elements are mounted by means of screws 85 inserted through holes in one of the casing elements and screwed into threaded holes in the other casing element. Pins 87 inserted in holes in the casing elements 75 and the tubular part 69, respectively secure the casing elements in correct position relative to the tubular part. Thus the screws 85 and pins 87 provide a mounting for the exchangeable casing provided by the casing elements 75.

At an outer end of each casing element and opposite the discharge opening 79 a wear pad 89 is exchangeably mounted by means of a screw 91.

Figure 5:
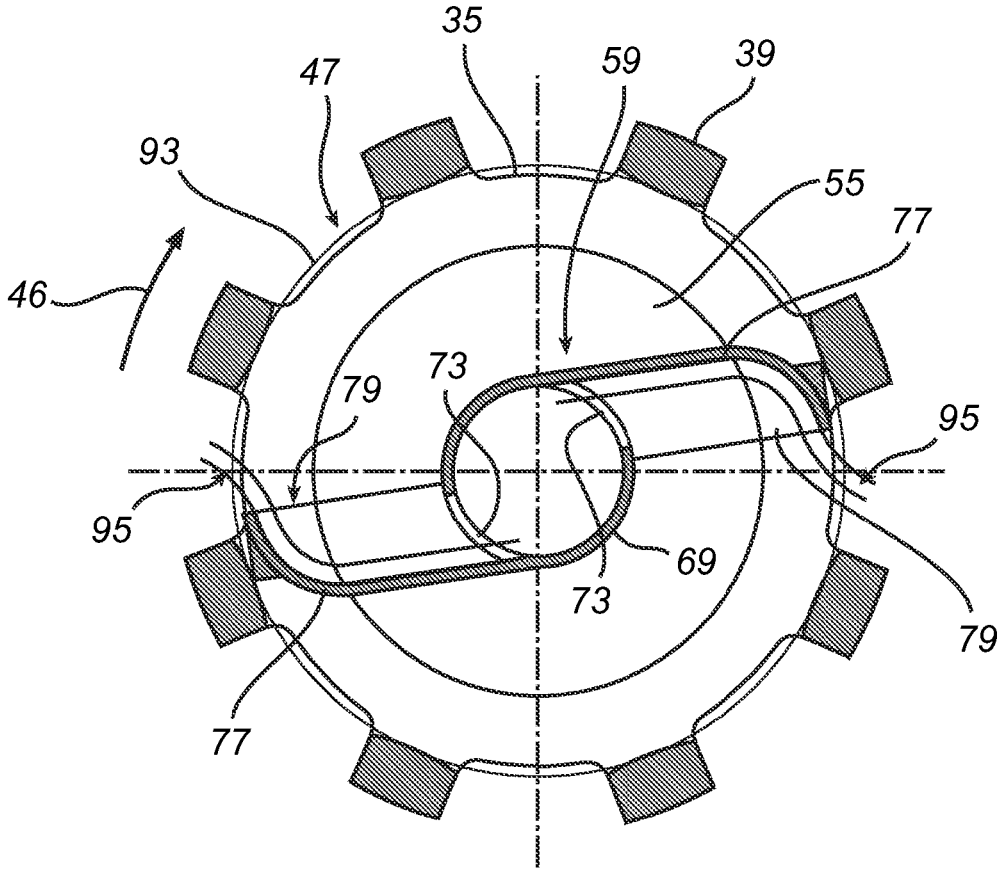
FIG. 5 is a schematic cross section of the feed accelerator in an acceleration chamber.

In use a liquid material e.g. a slurry comprising a light phase and a heavy phase is fed into the bowl 3 to form a liquid annular body with an upper surface 93. The annular body, the so-called pond, is rotating in the circumferential direction 46 at a high speed together with the bowl 3 and the screw conveyor 5, which are approximately, but not exactly, rotating at the same speed as it is well known to the skilled person. In the instance shown in FIG. 5 the pond substantially submerges the ribs 39. However the hub 33 should generally not be submerged. It is thus noted that the upper surface 93 of the pond is at a distance from the cylindrical part 35 of the hub 33 as shown in FIG. 5.

The slurry is separated in the separation chamber 45 and the light phase and the heavy phase exit the bowl 3 through the light phase outlet openings 13 and the heavy phase outlet openings 15, respectively.

Simultaneously slurry, called feed, is fed through the feed pipe 51.

From the feed pipe 51 the feed enters the tubular part 69 of the feed accelerator 59 and it exits the tubular part 69 through the discharge ports 73. The feed pipe 51 and the feed accelerator 59 are also rotating in the circumferential direction 46, but approximately at half the angular speed of the screw conveyor 5.

Having exited through the discharge ports 73 the feed is engaged by the curved wall parts 77 and is accelerated thereby. The feed thus flows along the curved wall parts 77 guided by the sidewall parts 81 to exit in the circumferential direction through the discharge openings 79.

It should be noted that the curved walls are curved overall comprising a straight part proximal to the tubular part 69 and a curved part distal from the tubular part 69.

Theoretically the feed will exit the discharge opening 79 at twice the linear speed of the curved wall part 77 at the discharge opening. Due to friction etc. the speed of the feed will however be a little lower. Ideally the feed would exit the discharge opening right onto the upper surface 93 with a circumferential speed equal to that of the upper surface, in order to avoid any turbulence created by the impact of the feed into the pond. However since a distance is present between the inner side of the curved wall part 77 at the discharge opening and the upper surface 93 the feed will hit the upper surface at a place of impact 95 with a direction having a radial component and a circumferential component. Since the radial distance from the centre, i.e. the axis of rotation 7 to the upper surface 93 is somewhat larger than the radial distance from the axis of rotation to the inner surface of the curved wall part 77 at the discharge opening 79, the linear speed of the upper surface 93 would be larger than the linear speed of the feed exiting the discharge opening if the rotational speed of the feed accelerator were exactly half the rotational speed of the screw conveyor 5. Therefore the rotational speed of the accelerator is regulated to a somewhat higher speed.

The decanter centrifuge comprises a control 97, which is connected (not shown) to and controlling the three motors i.e. the main motor 65 the feed pipe motor 61 and the control motor 31. The control 97 also monitors the power needed to run the respective motors.

Monitoring the overall power needed to run the main motor 65 and the feed pipe motor 61 may be used for determining the optimal rotational speed of the accelerator. If the accelerator runs too slow the feed will hit the pond at a circumferential speed lower than that of the upper surface 93 and the liquid below it, which means that the feed must be accelerated by the liquid of the pond, and turbulence is created. This turbulence entails a loss of energy. If the accelerator runs too fast the feed will hit the pond at a circumferential speed higher than that of the upper surface 93 and the liquid below it, which means that the feed is braked by the liquid of the pond, and turbulence is created. This turbulence entails a loss of energy. Further the power consumption of the feed pipe motor is relatively high and the power consumption of the main motor is relatively low compared to the former example. At the optimal rotational speed of the feed accelerator the minimum turbulence is created and the overall power consumption is minimal.

As mentioned it is an unwanted situation that the pond submerges the hub 33. Should the situation occur the upper surface 93 will be raised compared to what is shown in FIG. 5 and at least the wear pad 89 attached to the outside of the curved wall part 77 will dip into the upper surface 93. Since the pond like the conveyor 5 rotates at a speed much higher than the accelerator, a drop of the power needed by the feed pipe motor 61 will be detected by the control 97, thereby detecting the unwanted situation.

Since the rotational speed of the screw conveyor 5 is much larger than that of the feed accelerator 59 the ribs 39 will continuously run swiftly past the outer ends of the casing elements 75, and since material from the feed may deposit on the inner surfaces of the ribs there is a risk of impact between such deposit material and the casing elements 75. Such impact may abrade the wear pad 89 which thus may be worn, for which reason it is exchangeable.

Due to the construction of the feed pipe and the accelerator these parts are easily exchanged and/or mounted. Thus for mounting the feed pipe 51 with the tubular part 69 and the bearing 57 is inserted through the second shaft 21, and the bearing 57 is received by the mounting disc 55. Subsequently the casing elements 75 with the pins 87 are inserted through the feed ports 47 to be fastened by means of the screws 85, which are likewise inserted through the feed ports 47.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A centrifugal separator comprising:

a bowl rotating in use around an axis of rotation, said axis of rotation extending in a longitudinal direction of said bowl, a radial direction extending perpendicular to the longitudinal direction;

a conveyor arranged coaxially within said bowl and rotating in use around said axis of rotation, said conveyor comprising an acceleration chamber, a separation chamber being radially outwards limited by said bowl and radially inwards limited by said conveyor, said acceleration chamber being provided with a plurality of feed ports on an outer circumferential surface thereof for inlet of feed material into the separation chamber, each of the plurality of feed ports opening in said radial direction, and a feed accelerator arranged coaxially with said conveyor within said acceleration chamber and rotating in use around said axis of rotation relative to the conveyor at a lower speed than the conveyor, said feed accelerator having a discharge outlet for discharge of feed material through said discharge outlet into said acceleration chamber of the conveyor, wherein at least one of said plurality of feed ports extend a first axial area and said discharge outlet extends a second axial area, the first and the second axial area overlapping mutually such that feed material flows from the discharge outlet through the plurality of feed ports in direction having a radial and a circumferential component.

2. A centrifugal separator according to claim 1, wherein the second axial area extends within the first axial area.

3. A centrifugal separator according to claim 1, wherein the conveyor is rotated by a first drive, and the feed accelerator is rotated by a second drive, said first and second drives being controlled independently, such that in use, the angular velocity of said feed accelerator is set independent from the angular velocity of said conveyor.

4. A centrifugal separator according to claim 3, further comprising a means for monitoring the power consumption of said first and second drives, whereby the overall power consumption of said first and second drives is determined.

5. A centrifugal separator comprising:

a bowl rotating in use around an axis of rotation, said axis of rotation extending in a longitudinal direction of said bowl, a radial direction extending perpendicular to the longitudinal direction;

a conveyor arranged coaxially within said bowl and rotating in use around said axis of rotation, said conveyor comprising an acceleration chamber, a separation chamber being radially outwards limited by said bowl and radially inwards limited by said conveyor, said acceleration chamber being provided with feed ports for inlet of feed material into the separation chamber, and a feed accelerator arranged coaxially with said conveyor within said acceleration chamber and rotating in use around said axis of rotation relative to the conveyor at a lower speed than the conveyor, said feed accelerator having a discharge outlet for discharge of feed material through said discharge outlet into said acceleration chamber of the conveyor, wherein said feed ports extend a first axial area and said discharge outlet extends a second axial area, the first and the second axial area overlapping mutually such that feed material flows from the discharge outlet through feed ports in direction having a radial and a circumferential component; and wherein said feed accelerator comprises an inlet tube, said discharge outlet is provided by a discharge port in a side wall of said inlet tube and a casing having a curved wall part extending from said discharge port, such that said wall part extends tangentially from said inlet tube.

6. A centrifugal separator according to claim 5, wherein said feed accelerator comprises two discharge outlets.

7. A centrifugal separator according to claim 5, wherein said casing of the discharge outlet is provided by an exchangeable casing.

8. A centrifugal separator according to claim 7, wherein said exchangeable casing comprise mountings adapted for attachment of said casing to said inlet tube through said feed ports.

9. A centrifugal separator according to claim 5, wherein said casing at an end thereof opposite the inlet tube is provided with a wear pad.

10. A centrifugal separator according to claim 5, wherein said feed ports are defined by mutually spaced ribs, spaced apart and extending in the direction of said axis of rotation.

* * * * *